US005930920A

United States Patent [19]

Arnold

[11] Patent Number: 5,930,920

[45] Date of Patent: Aug. 3, 1999

[54] WIPING DEVICE FOR A GOLF CLUB FACE

[76] Inventor: Douglas Arnold, 2660 Montair, Long Beach, Calif. 90815

[21] Appl. No.: 09/049,685

[22] Filed: Mar. 27, 1998

[51] Int. Cl.[6] ..... A47K 7/04; A43B 5/00

[52] U.S. Cl. ..... 36/132; 36/136; 36/114; 36/127; 15/210.1; 15/244.1

[58] Field of Search ..... 36/114, 127, 132, 36/136, 1; 15/210.1, 244.1, 218.1, 227, 220.4

[56] References Cited

U.S. PATENT DOCUMENTS

| | | | |
|---|---|---|---|
| D. 81,305 | 6/1930 | Shoemaker | 15/218.1 |
| D. 350,232 | 9/1994 | Stangarone et al. | D4/116 |
| 1,770,420 | 7/1930 | Meyers | 15/218.1 |
| 3,813,722 | 6/1974 | Sapochinik | 15/104.5 |
| 4,122,577 | 10/1978 | Catania | 15/160 |
| 4,823,426 | 4/1989 | Bragga | 15/210.1 |
| 4,912,800 | 4/1990 | Zeltner | 15/222 |
| 4,940,349 | 7/1990 | Jansen van Rensburg | 401/10 |
| 5,075,918 | 12/1991 | Zeltner et al. | 15/210.1 |
| 5,203,048 | 4/1993 | Bynum | 15/160 |
| 5,230,117 | 7/1993 | Johnson et al. | 15/106 |
| 5,809,669 | 9/1998 | Hage et al. | 36/227 |

*Primary Examiner*—Paul T. Sewell
*Assistant Examiner*—Anthony Stashick
*Attorney, Agent, or Firm*—Gene Scott; Patent Law & Venture Group

[57] ABSTRACT

A golf club wiping and cleaning device is positioned by clipping it onto the upper side wall of a golf shoe in a position for wiping the club's face. The device provides a base portion and a replaceable cartridge with sliding engagement into the base. The base provides a clip on the back side of the base portion for shoe attachment.

10 Claims, 2 Drawing Sheets

WIPING DEVICE FOR A GOLF CLUB FACE

BACKGROUND OF THE INVENTION

1. Field of the Invention

This invention relates generally to golf club wiping and cleaning devices such as manual brushes and towels, and more particularly to a golf club face wiping device which may be attached to a golf shoe in a position for easily wiping the face in preparation for hitting a golf ball.

2. Description of Related Art

The following art defines the present state of this field: Catania, U.S. Pat. No. 4,122,577 describes in the driving of golf clubs, particularly on moist ground, divots and muddy earth are met by the driving head of the club and attached thereto, requiring removal repeatedly. This has meant in the past the carrying by the golfer of a wiping cloth and its use to clean the driving head of the club and which is time-taking and requires the golfer to handle a progressing dirty cloth. By means of the present invention, the golfer's shoe, either right or left, is provided with a plate, held by two or more of standard pointed shoe spikes, the plate carrying a wiping element for the club head and with a simple sweep-movement of the club its head is quickly cleaned with ease. The wiping element may be of brush form or a relatively soft upstanding element.

Bynum, U.S. Pat. No. 5,203,048 describes a golf club head brush for cleaning a golf club head comprises a relatively flat, generally-rectangular, handle having opposite brush and non-brush sides bounded by shaft, head, thumb and finger edges with brush bristles mounted on the brush side directed outwardly away from the handle. The handle is constructed of a resilient material so as to be bendable. The brush and non-brush sides have the generally-rectangular shape, but include a thumb protrusion at the thumb edge with bristles thereon. The shaft edge includes an outwardly flaring shaft slot therein for receiving a shaft when the bristles are used to clean a golf club head.

Zeltner, U.S. Pat. No. 4,912,800 describes a cleaning device for golfers has a towel body and a brush member is secured at one corner thereof. The brush member carry perpendicular bristles for scrubbing golf implements and equipment. In the apparatus and method of this preferred invention, the brush member is mechanically fused to the fibers of the towel body, but in an alternate form, the brush member includes a mounting plate that is mechanically fused to the fibers of the towel body and a brush element is releasably secured to the mounting plate. This is accomplished by melting back web portions of the brush and compressing the molten portions and a portion of the towel body together to fuse the fibers and molten portions to one another. The brush member is contoured to fit the golfers hand and to simulate a golf green; the towel body is printed with graphic elements to simulate a golf hole. A clip may be mounted on a comer of the towel body opposite the brush member so that, when the cleaning device is clipped to an erect golf bag, the towel body hangs uniformly alongside the golf bag.

Stangarone et al., U.S. Pat. No. Des. 350,232 shows a perspective view of the combined brush and sponge for cleaning golf clubs embodying the design of the present invention.

Jansen van Rensburg, U.S. Pat. No. 4,940,349 describes a manually grippable cleaner which is suitable for cleaning golf clubs. The cleaner consists of a rectangular ring which has internal bristles and into which the head of a club may be inserted. A cranked handle carries the ring. Thus with the club head in the ring, relative reciprocation between the ring and the club head will cause the club head to be cleaned by the bristles. An outside set of bristles is provided for cleaning "woods." The handle is hollow and comprises a chamber for cleaning fluid. A pump pumps the fluid to a nozzle to be sprayed on to the club face.

Johnson et al., U.S. Pat. No. 5,230,117 describes a golf shoe and golf club cleaning device particularly adapted for attachment to a golf bag or other convenient surface. The device includes a brush handle having soft bristles embedded in one face thereof and stiff bronze bristles embedded in an end wall that extends out of the general longitudinal extent of the handle at an angle thereto. The handle is tethered to a golf bag by a spring loaded cable that retracts into a casing and the cable is removably attached to a golf bag. By this arrangement, the brush is securely fastened to the golf bag or other convenient surface during normal play.

The prior art teaches various golf club face wiping devices. However, the prior art does not teach that such a wiping device may be advantageously attached to the side-wall of a golf shoe in a position so that the device is perfectly oriented for wiping a golf club face without repositioning the golf shoe or lifting the shoe. The prior art also does not teach that such a device may provide a replaceable cartridge in order to prolong the use of the device and to renew its viability when it become unusable. The present invention fulfills these needs and provides further related advantages as described in the following summary.

SUMMARY OF THE INVENTION

The present invention teaches certain benefits in construction and use which give rise to the objectives described below.

The present invention provides a golf club wiping and cleaning device that is preferably positioned by clipping it onto the upper side wall of a golf shoe in a position for wiping the club's face surface. The device provides a base portion and a replaceable cartridge with sliding engagement into the base. The unit provides a clip on the back side of the base portion.

A primary objective of the present invention is to provide a golf club wiper having advantages not taught by the prior art.

Another objective is provide such a wiper that is removably attachable to a shoe such that a golf club face is easily brought into contact with the wiper for cleaning the face.

A further objective is to provide such a wiper that has a replaceable cartridge to replace a worn-out wiping surface.

A still further objective is to provide such a wiper in combination with a shoe such that the combination ideally positions the wiping surface.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
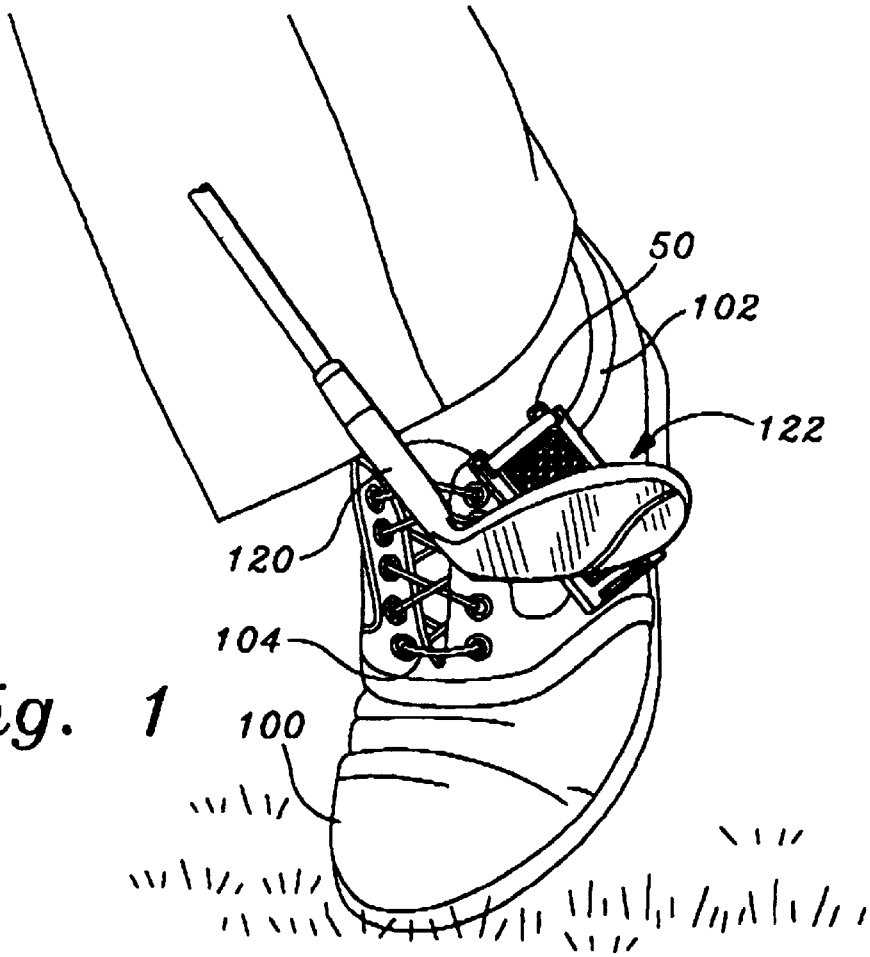
FIG. 1 is a perspective view of the preferred embodiment of the present invention showing its use as a wiper for a golf club face.
Figure 2:
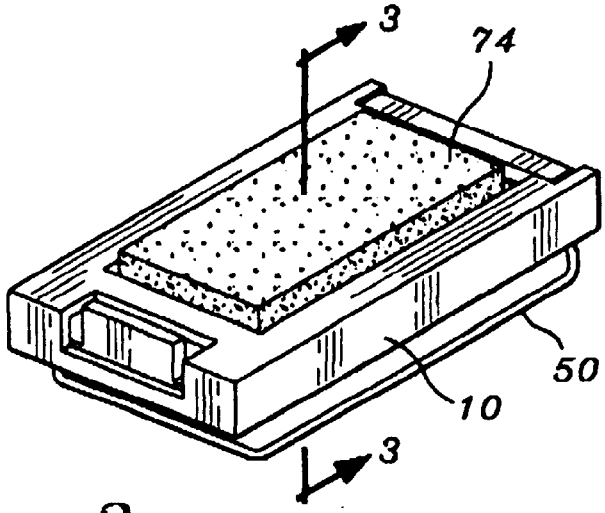
FIG. 2 is a perspective view thereof.
Figure 3:
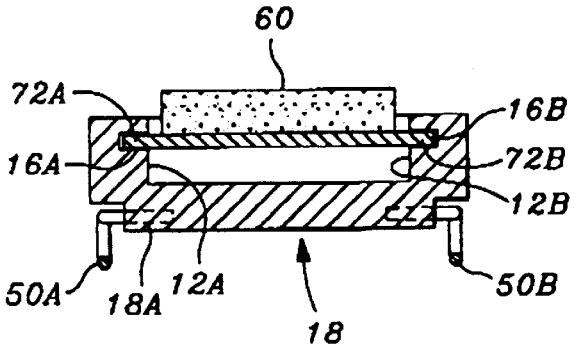
FIG. 3 is a sectional view thereof taken along line 3—3 in FIG. 2.

The above described drawing figures illustrate the invention, a device which as a part of a golf shoe 100 or, as used with the golf shoe, provides a wiping surface 60 to clean the face 122 of a golf club 120 as shown in FIG. 1.

Figure 4:
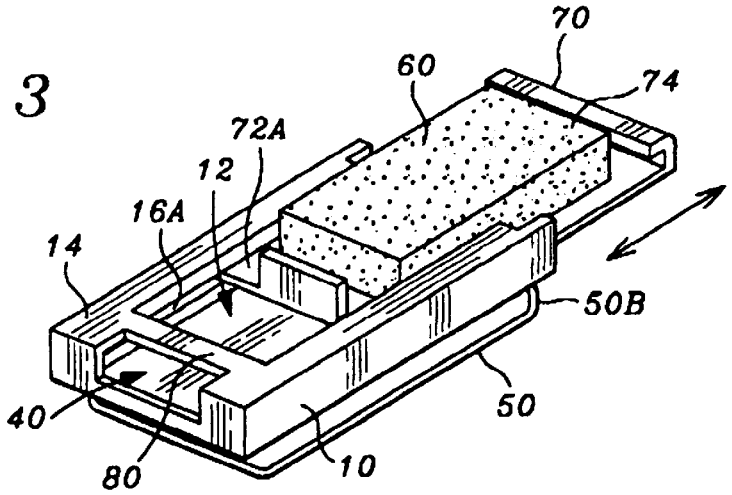
FIG. 4 is a further perspective view thereof as in FIG. 2 showing the manner in which a wiper cartridge of the invention engages a base portion thereof.
Figure 5:
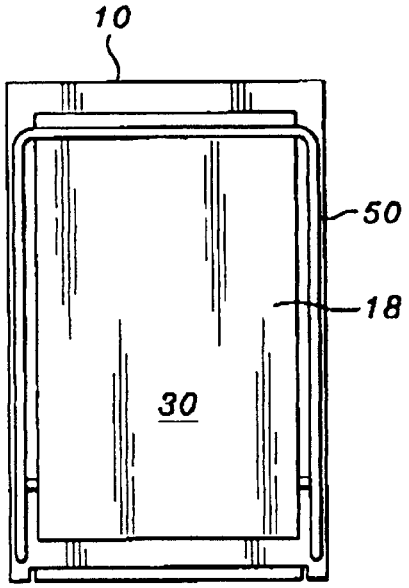
FIG. 5 is a bottom plan view thereof.

As shown in FIG. 4, the device is comprised of a base portion 10 having a cartridge engagement means 40. The base portion 10 is preferably a single molded plastic piece that is preferably rectangular in shape and contains a hollow depression 12 accessible from a front side 14. The cartridge engagement means 40 preferably includes a pair of opposing slots 16A and 16B positioned along the sides 12A and 12B of the depression 12. The slots 16A, 16B are positioned and spaced apart so as to allow a wiper cartridge 70 to be easily received within the hollow depression 16 of the base portion 10 without interference. The wiper cartridge 70 provides a pair of ears 72A and 72B, shaped and positioned to slide easily within the slots 16A, 16B respectively, of the base portion 10 as is best shown in FIG. 4. The slots 16A, 16B are sized to provide engagement of between 1/16 and 1/8 of an inch with ears 72A, 72B. Further, the base portion 10 provides a shoe contact surface 30 on a rear side 18, the rear side 18 being shown in FIG. 5.

The base portion 10 is further includes a shoe attachment means engagement means which is preferably a pair of opposing holes 18A and 18B on the rear side 18 of the base portion 10. Preferably the opposing holes 18A, 18B are aligned colinearly which allows a clip means 50 to be engagable within them for functionally positioning itself relative to the shoe contact surface 30. The fit between the shoe attachment means engagement means 18A, 18B and the clip means 50 are preferably, but not limited to, an interference fit or any other appropriate fit well known in the art that enables the clip means 50 to be fixed in the shoe attachment means engagement means 18.

Figure 6:
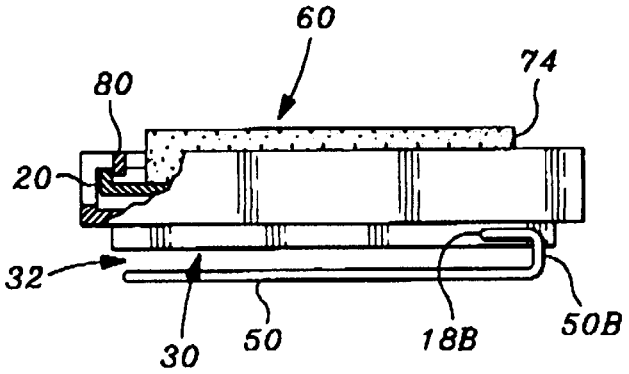
FIG. 6 is a side elevational view thereof with a partial cutaway showing further details as described below.

Further, the clip means 50 is engaged with the shoe attachment means engagement means 18 of the base portion 10 so as to be positioned in a spaced apart relationship with the shoe contact surface 30. The space 32 between the clip means 50 and the shoe contact surface 30 is preferably adjustable between 1/16 and 1/4 of an inch by simply bending the clip means 50 along clip means legs 50A and 50B. The clip means 50 is preferably a U-shaped, continuous spring wire that is bent such that when assembled to the base portion 10 it is parallel to the shoe contact surface 30 as best shown in FIG. 6. The device is removably engaged on the golf shoe side wall 102 as shown in FIG. 1 as the golf shoe side wall 102 is sandwiched between the shoe contact surface 30 and the clip means 50. The wire clip means 50 is preferably such as to not cause discomfort when walking. This is accomplished by positioning the clip at the forward end of the shoe's side wall and by using a relatively small gauge wire with high elasticity.

In the preferred embodiment of the invention, the replaceable wiper cartridge 70 is insertable into the cartridge engagement means 40 of the base portion 10 for orienting a wiper surface 60 of the cartridge away from the base portion 10. The wiper cartridge 70 is preferably an integral piece made of the same material as the base portion 10, preferably a molded plastic such as polyethylene or polypropylene, and provides a wiper material 74 mounted thereto. The wiper material 74 is preferably, but not limited to, a common sponge that is moistened prior to use, or a wire mesh-type surface, or a short bristle brush. It is fixed to the wiper cartridge 70 using a bonding agent such as epoxy, or any other acceptable adhesive well known in the art. The wiper material 74 is positioned on the wiper cartridge 70 for receiving the face 122 of the golf club 120 for wiping said face as shown in FIG. 1.

The base portion 10 of the device provides a cartridge locking means 80 which is preferably a ridge portion of the base portion 10 as shown in FIG. 6. The wiper cartridge 70 provides a resiliently positionable lip 20 for engaging the cartridge locking means 80, such that the cartridge 70 is thereby immovably engagable within the base portion 10 as shown in FIG. 6. With the wiper cartridge 70 fully inserted into the base 10, the positionable lip 20 engages the cartridge locking means 80 as shown in the breakaway portion of FIG. 6. To engage or disengage the wiper cartridge 70 from the cartridge locking means 80, the positionable lip 20 is simply depressed downwardly as the cartridge 70 is moved laterally within slots 16. The plastic material used to make the wiper cartridge 70 is resilient enough to allow this deflection.

In use, a golfer clips the device onto his golf shoe, inserting and pressing the sidewall 102 of the golf shoe 100 between the clip means 50 and the shoe contact surface 30. The device is positioned as shown in FIG. 1 whereby the device is located forward on the shoe 100 near the lasts 104. A right handed golfer would position the device on the outside wall of his left shoe. A left handed golfer would position the device on the outside wall of his right shoe. As is well known in the game technique of golf, one or more practice swings are usually taken by the golfer after positioning oneself to address the golf ball. Since a correct golf swing will normally cause the face of the golf club to become dirty or even caked with sod, the face must be cleaned off after any practice swings. The present invention enables this cleaning step to be taken without requiring the golfer to move away from the golf ball or loose his general train of thought and physical orientation with respect to the intended line of the shot. As shown in FIG. 1, a right handed golfer holds the club handle with his right hand and placed the golf club face 122 across his body and facing downwardly, this puts the face in the correct position so that the face of the club is parallel with the wiping surface 60. A simple back and forth rubbing of the club face, then, enables the face to be wiped clean. Soils that remain on the wiping surface 60 tend to drop to the ground so that the wiping surface 60 remains reasonably clean.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A device for use with a golf shoe for wiping the face of a golf club, the device comprising:

a base portion having a cartridge engagement means, a shoe attachment means engagement means and a shoe contact surface;

a replaceable wiper cartridge, the cartridge being insertable into the cartridge engagement means of the base portion for orienting a wiper surface of the cartridge away from the base portion;

and a clip means, the clip means being engagable with the shoe attachment means engagement means of the base portion for positioning the clip means in a spaced apart relationship with the shoe contact surface, such that with a side wall of the golf shoe sandwiched between the shoe contact surface and the clip means, the device is removably engaged on the golf shoe side wall and the wiper surface is positioned for receiving the face of the golf club for wiping said face.

2. The device of claim 1 wherein the cartridge engagement means is a pair of opposing slots, the slots being positioned and spaced apart for receiving the wiper cartridge.

3. The device of claim 1 wherein the shoe attachment means engagement means is a pair of opposing holes, the opposing holes being aligned colinearly, the clip means being engagable within the opposing holes for functionally positioning the clip means relative to the shoe contact surface.

4. The device of claim 1 wherein the base portion provides a cartridge locking means, and the wiper cartridge provides a resiliently positionable lip for engaging the cartridge locking means, such that the cartridge is thereby immovably engagable within the base portion.

5. The device of claim 1 wherein the clip means is a U-shaped, continuous spring wire.

6. A combination golf shoe and wiping device for wiping the face of a golf club, the combination comprising:

a golf shoe having a shoe side wall;

a wiping device comprising:

a base portion having a cartridge engagement means, a shoe attachment means engagement means and a shoe contact surface;

a replaceable wiper cartridge, the cartridge being insertable into the cartridge engagement means of the base portion for orienting a wiper surface of the cartridge away from the base portion;

and a clip means, the clip means being engagable with the shoe attachment means engagement means of the base portion for positioning the clip means in a spaced apart relationship with the shoe contact surface, such that with a side wall of the golf shoe sandwiched between the shoe contact surface and the clip means, the device is removably engaged on the golf shoe side wall and the wiper surface is positioned for receiving the face of the golf club for wiping said face.

7. The device of claim 6 wherein the cartridge engagement means is a pair of opposing slots, the slots being positioned and spaced apart for receiving the wiper cartridge.

8. The device of claim 6 wherein the shoe attachment means engagement means is a pair of opposing holes, the opposing holes being aligned colinearly, the clip means being engagable within the opposing holes for functionally positioning the clip means relative to the shoe contact surface.

9. The device of claim 6 wherein the base portion provides a cartridge locking means, and the wiper cartridge provides a resiliently positionable lip for engaging the cartridge locking means, such that the cartridge is thereby immovably engagable within the base portion.

10. The device of claim 6 wherein the clip means engagement means is a U-shaped, continuous spring wire.

* * * * *